United States Patent [19]

Kaneko et al.

[11] Patent Number: 4,983,313

[45] Date of Patent: Jan. 8, 1991

[54] REFRIGERATING MACHINE OIL COMPOSITION

[75] Inventors: Masato Kaneko, Ichihara; Minoru Takagi, Tokyo; Takashi Sunaga, Moriguchi; Takeo Komatsubara, Moriguchi; Taira Mutoh, Moriguchi, all of Japan

[73] Assignees: Idemitsu Kosan Co., Ltd., Tokyo; Sanyo Electric Co., Ltd., Osaka, both of Japan

[21] Appl. No.: 500,500

[22] Filed: Mar. 28, 1990

[30] Foreign Application Priority Data

Mar. 30, 1989 [JP] Japan ..... 64-76493

[51] Int. Cl.[5] ..... C10G 71/00

[52] U.S. Cl. ..... 252/68; 208/14; 208/18; 208/19; 585/1; 585/6.6

[58] Field of Search ..... 252/68; 208/14, 19, 208/18; 585/1, 6.6

[56] References Cited

U.S. PATENT DOCUMENTS

| | | | |
|---|---|---|---|
| 3,169,928 | 2/1965 | Herold | 252/68 |
| 3,715,302 | 2/1973 | Mills et al. | 252/68 |
| 4,046,533 | 9/1977 | Olund | 252/68 |
| 4,431,557 | 2/1984 | Shimizu et al. | 252/68 |
| 4,510,062 | 4/1985 | Nakanishi | 252/45 |
| 4,800,013 | 1/1989 | Yamane et al. | 208/18 |

*Primary Examiner*—Jacqueline V. Howard

*Attorney, Agent, or Firm*—Antonelli, Terry, Stout & Kraus

[57] ABSTRACT

Disclosed is a refrigerating machine oil composition comprising:

(A) 85 to 30% by weight of alkyl benzene having a kinematic viscosity at 40° C. of 30 cSt or more;

(B) 5 to 70% by weight of a paraffin-based mineral oil having a kinematic viscosity at 40° C. of 20 to 500 cSt, a pour point of −35° C. or lower, a viscosity index of 60 or more, and a sulfur content of 100 ppm or less; and (C) 1 to 30% by weight of a naphthene-based mineral oil having a kinematic viscosity at 40° C. of 5 to 500 cSt, a pour point of −30° C. or lower, and a sulfur content of 0.05 to 1% by weight, the total sulfur content of said composition being 0.01 to 0.10% by weight.

The present composition is excellent in stability, lubricity, compatibility with refrigerants, and low temperature property.

12 Claims, No Drawings

REFRIGERATING MACHINE OIL COMPOSITION

BACKGROUND OF THE INVENTION

1. Field of the Invention

The present invention relates to a refrigerating machine oil composition. More particularly, it relates to a lubricating oil composition for use in refrigerating machine, which has excellent low temperature properties including a low flock point, excellent stability and lubricity in a Flon refrigerant, and further, a favorable compatibility with the Flon refrigerant in spite of its comparatively high viscosity. In the specification, Flon means a fluorocarbon, a chloro-fluorocarbon, a fluorohydrocarbon or a chlorofluoro-hydrocarbon.

2. Description of the Related Arts

Generally, refrigerating machine oils are required to have properties such as;

(1) a favorable compatibility with a refrigerant, (2) a favorable stability in contact with a refrigerant, (3) a favorable lubricity (anti-seizure property, anti-wear property).

As refrigerating machine oils satisfying these requirements, there are known those that are improved in stability, lubricity and low temperature property by mixing different base oils and adjusting thier sulfur content (Japanese patent application Laid-Open No. 295995/1987). However, such refrigerating machine oils having a comparatively high viscosity, as used in refrigerating machine employing a rotary compressor, have problems particularly in that (i) the compatibility with Flon refrigerant is low, (ii) the two-layer separation temperature rises, (iii) a poor oil returning from evaporator occurs in the system, and (iv) the flock point rises to cause a poor low temperature property.

SUMMARY OF THE INVENTION

An object of the present invention is to provide a refrigerating machine oil having favorable compatibility with a refrigerant in spite of its comparatively high viscosity, and also a favorable low temperature property, stability and lubricity in Flon refrigerant.

It has been found that the object is attained by blending a specific paraffin-based mineral oil and a naphthene-based mineral oil with alkyl benzene having a comparatively high viscosity, i.e., kinematic viscosity at 40° C. of 30 cSt or more, in a prescribed amount.

That is, the present invention provides a refrigerating machine oil composition comprising:

(A) 85 to 30% by weight of alkyl benzene having a kinematic viscosity at 40° C. of 30 cSt or more;

(B) 5 to 70% by weight of a paraffin-based mineral oil having a kinematic viscosity at 40° C. of 20 to 500 cSt, a pour point of −35° C. or lower, a viscosity index of 60 or more, and a sulfur content of 100 ppm or less; and (C) 1 to 30% by weight of a naphthene-based mineral oil having a kinematic viscosity at 40° C. of 5 to 500 cSt, a pour point of −30° C. or lower, and a sulfur content of 0.05 to 1% by weight, the total sulfur content of said composition being 0.01 to 0.10% by weight.

DESCRIPTION OF PREFERRED EMBODIMENTS

The alkyl benzene to be used as component (A) of the present invention has a comparatively high viscosity compared with alkyl benzene used in the conventional refrigerating machine oils, usually a kinematic viscosity at 40° C. of 30 cSt or more, preferably 50 to 500 cSt, and more preferably 70 to 400 cSt. If the kinematic viscosity is less than 30 cSt, the lubricity decreases and a property for swelling rubber increased undesirably.

As such alkyl benzene having a high viscosity, various ones can be mentioned. Alkyl benzene (e.g., monoalkyl benzene, dialkyl benzene, trialkyl benzene) having 20 or more of the total carbon atoms of its alkyl group (the total sum of the carbon atoms in each alkyl group when the number of alkyl groups is plural), preferably alkyl benzene such as dialkyl benzene having 20 or more total carbon atoms and 2 or more alkyl groups can be used. Said alkyl benzene having a high viscosity may be used alone or in a mixture of 2 or more kinds, if its kinematic viscosity is within the above range.

The paraffin-based mineral oil to be used as component (B) of the present invention has a kinematic viscosity at 40° C. of 20 to 500 cSt, preferably 30 to 450 cSt, and most preferably 70 to 400 cSt, and a viscosity index of 60 or more, preferably 70 or more. If the kinematic viscosity is less than 20 cSt, the lubricity, particularly the anti-seizure property and anti-wear property decrease markedly, which makes running of the refrigerating machine impossible. If it exceeds 500 cSt, the energy loss due to the viscous drag will undesirably increase. On the other hand, if the viscosity index is less than 60, the stability will be lowered. The paraffin-based mineral oil to be used as component (B) has a pour point of −35° C. or lower, preferably −40° C. or lower, and a sulfur content of 100 ppm or less, preferably 50 ppm or less. If the pour point is higher than −35° C., the refrigerating machine oil is difficult to work smoothly at extremely low temperatures. If the sulfur content exceeds 100 ppm, the stability in an atmosphere of Flon will undesirably be lowered.

Component (B) of the present invention is a paraffin-based mineral oil as described above, which is obtained by purifying a distillate oil (boiling point: 250 to 450° C. under atmospheric pressure) obtained by the distillation of a paraffin-based crude oil by the usual method, and then subjecting the purified oil to a deep dewaxing treatment (hydrogenation dewaxing treatment employing zeolite catalysts). The distillate oil can be obtained by atmospheric distillation or vacuum distillation of a residual oil resulting from the atmospheric distillation. The method of purification of the distillate oil is not critical, and the distillate oil can be purified by any of methods as follows: (1) a method in which the distillate oil is hydrogenated, or after hydrogenation, it is further subjected to alkali distillation or sulfuric acid washing, (2) a method in which the distillate oil is subjected to solvent extraction treatment, or after solvent extraction treatment, it is further subjected to alkali distillation or sulfuric acid washing, (3) a method in which the distillate oil is hydrogenated and then it is further subjected to the second stage hydrogenation, (4) a method in which the distillate oil is hydrogenated and then it is further subjected to the second and third stage hydrogenation, (5) a method in which the distillate oil is hydrogenated and it is subjected to the second stage hydrogenation, and further is subjected to alkali distillation or sulfuric acid washing. Examples of the treatments are described in Japanese patent application Laid-Open No. 295995/1987.

According to the above methods, a paraffin-base mineral oil having the above properties can be obtained, and further it is preferable that said oil is subjected to clay treatment.

The present composition is obtained further by blending a naphthene-based mineral oil as component (C) with the above components (A) and (B).

The naphthene-based mineral oil to be used as component (C) of the present invention has a kinematic viscosity at 40° C. of 5 to 500 cSt, preferably 6 to 300 cSt, a pour point of −30° C. or lower, preferably −40° C. or lower, and a sulfur content of 0.05 to 1% by weight, preferably 0.1 to 0.6% by weight. If the kinematic viscosity at 40° C. is less than 5 cSt, the anti-seizure property becomes poor. If it exceeds 500 cSt, the energy loss due to the viscous drag will undesirably increase. If the pour point exceeds −30° C., the smooth working of the refrigerating machine oil at low temperatures becomes difficult. If the sulfur content is less than 0.05% by weight, the desired refrigerating machine oil composition cannot be obtained. If it exceeds 1% by weight, the stability under Flon refrigerant decreases undesirably.

The process for production of the above naphthene-based oil is not critical. Generally, it is preferable that the fraction obtained by atmospheric distillation or vacuum distillation of a naphthene-based crude oil is solvent extracted by the usual method, and then the raffinate is subjected to hydrogenation or clay treatment.

The refrigerating machine oil composition of the present invention comprises 85 to 30% by weight, preferably 80 to 35% by weight of the above component (A), 5 to 70% by weight, preferably 10 to 60% by weight of component (B), and 1 to 30% by weight, preferably 3 to 20% by weight of component (C). If component (A) exceeds 85% by weight, the anti-seizure property of the resulting composition is lowered, and if it is less than 30% by weight, the stability and compatibility with a refrigerant becomes undesirably poor. If component (B) exceeds 70% by weight, the compatibility with a refrigerant of the resulting composition decreases, and if it is less than 5% by weight, the lubricity becomes insufficient. If component (C) exceeds 30% by weight, the stability of the resulting composition decreases, and if it is less than 1% by weight, the lubricity of the resulting composition and its compatibility with a refrigerant are lowered.

The present composition is obtained by blending the above components (A), (B), and (C) in the above amount range, and further adjusting the sulfur content of the whole composition to 0.01 to 0.10% by weight, preferably 0.02 to 0.06% by weight based on the total amount of the composition. Even if the above three components are blended in each a prescribed amount, the object of the present invention cannot be attained unless the total sulfur content is within the above described range. According, it is essential that the sulfur content be within the range of 0.01 to 0.10% by weight. If the sulfur content is less than 0.01% by weight, the lubricity decreases, and if it exceeds 0.10% by weight, the stability is lowered, and such a composition is impractical.

The composition of the present invention requires no particular property so long as the sulfur content should be within the above range, and it is preferable that the kinematic viscosity at 40° C. is 15 cSt or more, preferably 15 to 400 cSt.

The refrigerating machine oil composition of the present invention comprises the above three components as the main components, and if necessary, various additives usually used can be blended appropriately. Examples of the additives are extreme pressure agents or oiliness agents such as tricresylphosphate, dioctyladipate and fluorosilicone, chlorine capturing agents such as glycidylether-type epoxy compounds, antioxidants such as α-naphthylamine, and 2,6-di-tert-butyl-paracresol (DBPC), metal deactivators such as benzotriazol, defoaming agents such as silicone oil, and the like.

The refrigerating machine oil composition of the present invention, as described above, has a good stability and lubricity in Flon refrigerant, and also has a favorable compatibility with the refrigerant and a low temperature property even at comparatively high viscosity.

Consequently, the composition of the present invention can effectively be used as a lubricating oil for use in refrigerating machines such as home or automobile air-conditioners and household refrigerator.

The present invention is described in greater detail with reference to the following examples.

EXAMPLES 1 TO 6, COMPARATIVE EXAMPLES 1 TO 10

Alkyl benzene, a paraffin-based mineral oil and a naphthene-based mineral oil were blended in the prescribed amount to obtain a refrigerating machine oil composition, which was made a sample oil. The properties of said oil were measured according to the process shown below. The results are shown in Table 1.

Anti-seizure Property Test

According to ASTM D 3233, the seizure load (by the pound) after running at an oil temperature of 30° C. at a load of 150 pounds for 5 minutes was measured.

Anti-wear Property Test

According to ASTM D 2670, the sample oil was measured at a load of 150 pounds for 1 hour, employing monochlorodifluoromethane (Flon-22) as a refrigerant, in the blowing amount of 10 L (L=liter)/hour.

Sealed Tube Test

A mixture of a sample oil and Flon refrigerant in the ratio of 2:1 (by weight) was sealed in the ampul together with catalysts of iron, copper and aluminum. The ampul was heated for 720 hours at 175° C. and then its appearance and the amount of the resulting hydrochloric acid (mg.HCl/4ml) in the ampul were measured.

Two-layer Separation Temperature 4 g of the mixture of a sample oil and Flon-22 in the ratio of 85:15 (by weight) was sealed in the ampul for a sealed tube. The ampul was cooled successively from 80° C. and the temperature at which the mixture separated into the two layers were measured.

Rubber Swelling 100 g of a sample oil and rubber (material: NBR, form: dumbbell specimen according to JIS K 6301) were placed in an autoclave, and then dichlorodifluoromethane (Flon-12) was introduced therein and sealed in at 150° C. for 10 days. After that, the rubber swelling was measured.

Standard of Evaluation

A: less than 5% swelling

B: 5 to less than 10% swelling

C: 10% or more swelling

Sealed Flock Point 0.4 g of oil was placed in a 10 ml pressure glass ampul. While the pressure in the ampul was reduced and the ampul was cooled by the use of liquid nitrogen, 3.6 g of refrigerant was put in and sealed by a burner. The sealed ampul at the ordinary temperature was transferred to a low temperature bath and cooled stepwise. The inside of the ampul at each temperature was observed. In this observation, the temperature at which the flock occurs, was made flock point.

TABLE 1

| No. | Composition (% by weight) Component (A) $A_1$*1 | $A_2$*2 | $A_3$*3 | Component (B) $B_1$*4 | $B_2$*5 | $B_3$*6 | $B_4$*7 | Component (C) $C_1$*8 | Sulfur Content (% by weight) |
|---|---|---|---|---|---|---|---|---|---|
| Example 1 | 50 | — | — | 40 | — | — | — | 10 | 0.03 |
| Example 2 | — | 50 | — | 40 | — | — | — | 10 | 0.03 |
| Example 3 | 50 | — | — | — | 40 | — | — | 10 | 0.03 |
| Example 4 | 70 | — | — | 25 | — | — | — | 5 | 0.02 |
| Example 5 | — | 40 | — | — | 45 | — | — | 15 | 0.05 |
| Example 6*9 | — | 75 | — | 15 | — | — | — | 10 | 0.03 |
| Comparative Example 1 | — | — | — | 75 | — | — | — | 25 | 0.07 |
| Comparative Example 2 | — | — | — | — | — | — | 75 | 25 | 0.45 |
| Comparative Example 3 | 90 | — | — | — | 5 | — | — | 5 | 0.02 |
| Comparative Example 4 | 2 | — | — | 75 | — | — | — | 23 | 0.07 |
| Comparative Example 5 | — | 30 | — | 20 | — | — | — | 50 | 0.15 |
| Comparative Example 6 | — | — | 50 | — | 40 | — | — | 10 | 0.03 |
| Comparative Example 7 | — | 50 | — | — | — | 40 | — | 10 | 0.03 |
| Comparative*9 Example 8 | — | — | 100 | — | — | — | — | — | 0.01 or lower |
| Comparative Example 9 | — | 80 | — | — | — | — | — | 20 | 0.06 |
| Comparative*10 Example 10 | | | | commercially available | | | | | 0.04 |

| No. | Lubricity: Anti-seizure Property (pound) | Lubricity: Anti-wear Property (mg) | Sealed Tube Test: Appearance | Sealed Tube Test: Amount of Generated HCl | Two-layer Separation Temperature | Rubber Swelling | Sealed Flock Point |
|---|---|---|---|---|---|---|---|
| Example 1 | 490 | 2 | good | 0.2 | less than 30° C. | A | −40° C. or lower |
| Example 2 | 450 | 2 | good | 0.2 | less than 30° C. | A | −40° C. or lower |
| Example 3 | 450 | 4 | good | 0.2 | less than 30° C. | A | −40° C. or lower |
| Example 4 | 470 | 7 | good | 0.1 | less than 30° C. | A | −40° C. or lower |
| Example 5 | 400 | 3 | good | 0.3 | less than 30° C. | A | −40° C. or lower |
| Example 6*9 | 650 | 1 | good | 0.2 | less than 30° C. | A | −40° C. or lower |
| Comparative Example 1 | 480 | 3 | good | 5.8 | 80° C. or more | A | −40° C. or lower |
| Comparative Example 2 | 480 | 2 | discolored | 20 or more | 80° C. or more | A | −20° C. |
| Comparative Example 3 | 430 | 12 | good | 0.2 | less than 30° C. | A | −40° C. or lower |
| Comparative Example 4 | 440 | 2 | discolored | 5.8 | 30° C. or more | A | −40° C. or lower |
| Comparative Example 5 | 400 | 2 | discolored | 12.0 | less than 30° C. | A | −40° C. or lower |
| Comparative Example 6 | 250 | seizure | good | 0.2 | less than 30° C. | B | −40° C. or lower |
| Comparative Example 7 | 280 | seizure | good | 0.2 | less than 30° C. | A | −40° C. or lower |
| Comparative*9 Example 8 | 450 | 15 | good | 0.2 | less than 30° C. | C | −40° C. or lower |
| Comparative Example 9 | 360 | 10 | good | 0.4 | less than 30° C. | A | −40° C. or lower |
| Comparative*10 Example 10 | 430 | 3 | discolored | 20 or more | less than 30° C. | A | −40° C. or lower |

*1alkyl benzene (kinematic viscosity at 40° C.: 83 cSt)
*2alkyl benzene (kinematic viscosity at 40° C.: 56 cSt)
*3alkyl benzene (kinematic viscosity at 40° C.: 14 cSt)
*4paraffin-based mineral oil (kinematic viscosity at 40° C.: 110 cSt, pour point: −45° C., viscosity index: 100, sulfur content: 5 ppm or less)
*5paraffin-based mineral oil (kinematic viscosity at 40° C.: 36 cSt, pour point: −45° C., viscosity index: 100, sulfur content: 5 ppm or less)
*6paraffin-based mineral oil (kinematic viscosity at 40° C.: 8 cSt, pour point: −45° C., viscosity index: 80, sulfur content: 5 ppm or less)
*7paraffin-based mineral oil (kinematic viscosity at 40° C.: 105 cSt, pour point: −15° C., viscosity index: 95, sulfur content: 0.5% by weight)
*8naphthene-based mineral oil (kinematic viscosity at 40° C.: 9 cSt, pour point: −50° C., sulfur content: 0.3% by weight)
*90.5% by weight of tricresylphosphate as an extreme pressure agent was added.
*10naphthene-based mineral oil (kinematic viscosity at 40° C.: 29 cSt, pour point: −45° C., sulfur content: 0.04% by weight)

EXAMPLE 7

The refrigerating machine oil composition obtained in Example 2 was used in a rotary compressor (using Flon R-12 (dichlorodifluoromethane)) for 2 months and the hue of the sample oil was measured. The hue was 0.5 by measuring according to JIS K-2580.

COMPARATIVE EXAMPLE 11

The procedure of Example 7 was repeated except that the sample oil of Comparative Example 10 was used in place of the refrigerating machine oil composition obtained in Example 2. As a result, the hue was 0.2.

As the above result, the present composition (Examples 1 to 6) has a good lubricity (seizure load: over 400 pounds, wear amount: less than 10 mg) and a high stability (good appearance, amount of generated HCl: less than 0.5 mg HCl/ 4 ml) as well as good properties such as two-layer separation temperature of less than 30° C., rubber swelling of less than 5% and sealed flock point of −40° C. or lower. The appearance (hue) in Example 7 hardly changed and the stability was high.

On the other hand, when component (A) was not contained, the two-layer separation temperature rose markedly and the stability became insufficient (cf. Comparative Examples 1 and 2). And also, when component (A) was contained in a small amount, the result was the same (cf. Comparative Example 4).

Further, when component (A) having a low viscosity was used, the lubricity decreased and the rubber swelling was increased (cf. Comparative Example 6). When component (A) was contained in an excessive amount, the lubricity became insufficient (wear amount: 12 mg) (cf. Comparative Example 3). When component (A) having a low viscosity was used, the anti-wear property was insufficient and the rubber swelling was increased even if the extreme pressure agent was added (cf. Comparative Example 8).

When component (B) was not contained, the lubricity was insufficient (cf. Comparative Example 9), and when component (B) having a low viscosity was used, the result was the same (cf. Comparative Example 7).

When component (C) was used in an excessive amount, the stability became poor (cf. Comparative Example 5).

What is claimed is:

1. A refrigerating machine oil composition comprising:

(A) 85 to 30% by weight of alkyl benzene having a kinematic viscosity at 40° C. of 30 cSt or more;

(B) 5 to 70% by weight of a paraffin-based mineral oil having a kinematic viscosity at 40° C. of 20 to 500 cSt, a pour point of −35° C. or lower, a viscosity index of 60 or more, and a sulfur content of 100 ppm or less; and (C) 1 to 30% by weight of a naphthene-based mineral oil having a kinematic viscosity at 40° C. of 5 to 500 cSt, a pour point of −30° C. or lower, and a sulfur content of 0.05 to 1% by weight, the total sulfur content of said composition being 0.01 to 0.10% by weight.

2. A refrigerating machine oil composition according to claim 1 wherein the alkyl benzene has a kinematic viscosity at 40° C. of 50 to 500 cSt.

3. A refrigerating machine oil composition according to claim 1 wherein the alkyl benzene has a kinematic viscosity at 40° C. of 70 to 400 cSt.

4. A refrigerating machine oil composition according to claim 1 wherein the paraffin-based mineral oil has a pour point of −40° C. or lower.

5. A refrigerating machine oil composition according to claim 1 wherein the paraffin-based mineral oil has a viscosity index of 70 or more.

6. A refrigerating machine oil composition according to claim 1 wherein the paraffin-based mineral oil has a sulfur content of 50 ppm or less.

7. A refrigerating machine oil composition according to claim 1 wherein the paraffin-based mineral oil has a pour point of −40° C. or lower, a viscosity index 70 or more, and a sulfur content of 50 ppm or less.

8. A refrigerating machine oil composition according to claim 1 wherein the naphthene-based mineral oil has a pour point of −40° C. or lower.

9. A refrigerating machine oil composition according to claim 1 wherein the naphthene-based mineral oil has a sulfur content of 0.1 to 0.6% by weight.

10. A refrigerating machine oil composition according to claim 1 wherein the naphthene-based mineral oil has a pour point of −40° C. or lower, and a sulfur content of 0.1 to 0.6% by weight.

11. A refrigerating machine oil composition according to claim 1, comprising 80 to 35% by weight of the alkyl benzene, 10 to 60% by weight of the paraffin-based mineral oil and 3 to 20% by weight of the naphthene-based mineral oil.

12. A refrigerating machine oil composition according to claim 1 wherein the total sulfur content is 0.02 to 0.06% by weight.

* * * * *